United States Patent [19]

Nishiyama et al.

[11] Patent Number: 4,856,854

[45] Date of Patent: Aug. 15, 1989

[54] TOWEL DISPENSER

[75] Inventors: Masanobu Nishiyama; Haruo Nishimura, both of Osaka; Katsuji Nakano, Nishinomiya; Ozaki: Tatsuo, Kyoto; Akira Kitamoto, Ikoma, all of Japan

[73] Assignees: Duskin Co., Ltd., Osaka; Matsushita Electric Industrial Co., Kadoma, both of Japan

[21] Appl. No.: 63,629

[22] Filed: Jun. 19, 1987

[51] Int. Cl.[4] ..... B65H 19/00

[52] U.S. Cl. ..... 312/38; 70/139; 292/198; 312/39; 312/215; 312/328

[58] Field of Search ..... 312/37, 38, 39, 40, 312/41, 215, 222, 333, 328, 138 R, 139, 109; 220/335; 70/137, 139; 292/198, 220

[56] References Cited

U.S. PATENT DOCUMENTS

| | | | |
|---|---|---|---|
| 13,722 | 10/1855 | Holmes et al. | 292/198 X |
| 917,664 | 4/1909 | Roy | 292/198 |
| 2,367,200 | 1/1945 | Cooper | 312/38 |
| 2,817,554 | 12/1957 | Hasselmark | 292/198 X |
| 2,834,645 | 5/1958 | Birr | 312/38 |
| 2,899,251 | 8/1959 | Birr | 312/38 |
| 3,214,226 | 10/1965 | Bahnsen | 312/38 |
| 3,684,338 | 8/1972 | Bahnsen | 312/38 |
| 4,742,598 | 5/1988 | Bruneau | 220/335 X |

*Primary Examiner*—Peter A. Aschenbrenner
*Assistant Examiner*—Thomas A. Rendos
*Attorney, Agent, or Firm*—Cushman, Darby & Cushman

[57] ABSTRACT

A towel dispenser which includes a mechanism for eliminating towel sidewise displacement, a device for keeping a front lid open, and a locking device.

8 Claims, 7 Drawing Sheets

TOWEL DISPENSER

BACKGROUND OF THE INVENTION

1. Field of the Invention:

The present invention relates to a towel dispenser.

2. Description of the Prior Art:

A towel dispenser which accomodates a roll of towel is known. A user pulls the towel out of the dispenser to a position where it can be used, and the used towel is automatically rolled into the dispenser.

Such a known towel dispenser includes a body fixed onto the wall or the like, and a towel unit detachably mounted in the body. The towel unit is covered with a cover which is mounted on the body in such a manner as to be openable.

The towel hangs below the body to form a loop, and the user wipes his hands on this towel loop.

The above-described type of towel dispenser is classified into two types: one in which the towel always forms a loop, and the other in which a taxi roller which moves up and down forms a towel loop only when the towel is used. In either type, the towel is rolled up either upward or downward.

The known towel dispenser is not equipped with means for guiding the vertical movement of the towel, and the towel may therefore snake or be wound at a slant. These faults inhibit the rolling up of the towel, or the resultant load applied to the supply roller or winding roller by the rolled towel may break it.

When the towel is replaced in such a towel dispenser, the cover constituting the front lid must be opened, and the towel must be replaced while the cover is held open with one hand.

Furthermore, since the cover can be opened freely, the towel stored in the dispenser is often stolen or is damaged.

SUMMARY OF THE INVENTION

Accordingly, an object of the present invention is to provide a towel dispenser which permits no sidewise displacement of a towel while it is moved up and down.

A second object of the present invention is to provide a towel dispenser having a front lid which can be kept open during the replacement of the towel.

A third object of the present invention is to provide a towel dispenser which can be locked so that the cover cannot be opened from the outside.

To achieve these objects, the present invention provides in one of its aspects a towel dispenser incorporating a pair of guide plates extending in the vertical direction along the towel passageway in the frame of a body at the same spacing as the width of the towel.

When it is moved up and down, the towel passes between the pair of guide plates so that the sidewise displacement of the towel can be prevented, thereby preventing the towel snaking or becoming inclined and enabling it to be fed on a straight line.

The present invention provides in another of its aspects a towel dispenser which incorporates: a cover secured to the upper end portions of right and left side plates of a towel dispenser body as a front lid in such a manner as to be openable; a pin for pivotally supporting the cover, the pin being provided on a tab projecting toward the body from each edge of the upper end portion of the cover; a pivot arm having one end pivotally supported on the outer side of each side plate of the body and another, free end which can be pivoted upward; and a roller provided at the free end of the pivot arm and located at a position where it can be engaged with each tab of the cover through an opening formed on each side plate.

This arrangement of the towel dispenser makes it possible for the cover to be kept open. It provides a large space through which the towel can be replaced, thereby facilitating the towel replacement work.

The present invention provides in another of its aspects a towel dispenser which incorporates: a pivot rod pivotally supported between two side plates of a towel dispenser body at a position where it does not interrupt the feeding of a towel, the pivot rod having arms at two ends thereof which extend forward in such a manner that they form right angles; a pin provided on the inner side of the leading end of each of the arms of the pivot rod, the pin being received in a notch of a tab provided on the inner side of each edge of the lower end portion of the openable cover; and a disk rotatably provided on a outer frame fixed to the outer side of each side plate of the body in such a manner as to cover the side plate, the disk having openings into which the prongs of a key can be engaged.

In the towel dispenser of this invention, the pivot rod having two arms is supported at the lower portion of the body in such a manner as to be able to pivot upward. The lower end portion of the openable cover is provided with tabs, each tab having a notch which engages with a pin provided on the leading end of each arm. The arms are pivoted by the turning of a key from outside.

In consequence, the cover can be locked in normal operations by using this locking mechanism. It can be opened only when the towel is replaced, preventing the theft or damage of the towel.

The cover can be unlocked by inserting a key into key holes and turning it in either direction. This does not require a complicated operation, and can thereby be done with one hand.

The cover can be opened and kept open with one hand by a simple operation. It remains open so long as no displacement is appied thereto.

Other and further objects of this invention will become obvious upon an understanding of the illustrative embodiment about to be described, or will be indicated in the appended claims, and various advantages not referred to therein will occur to one skilled in the art upon employment of the invention in practice.

BRIEF DESCRIPTION OF THE DRAWINGS

In the drawings in which an embodiment of the present invention is illustrated.

DESCRIPTION OF THE PREFERRED EMBODIMENT

An embodiment of the present invention will be hereinunder described in detail by referring to the accompanying drawings.

Figure 1:
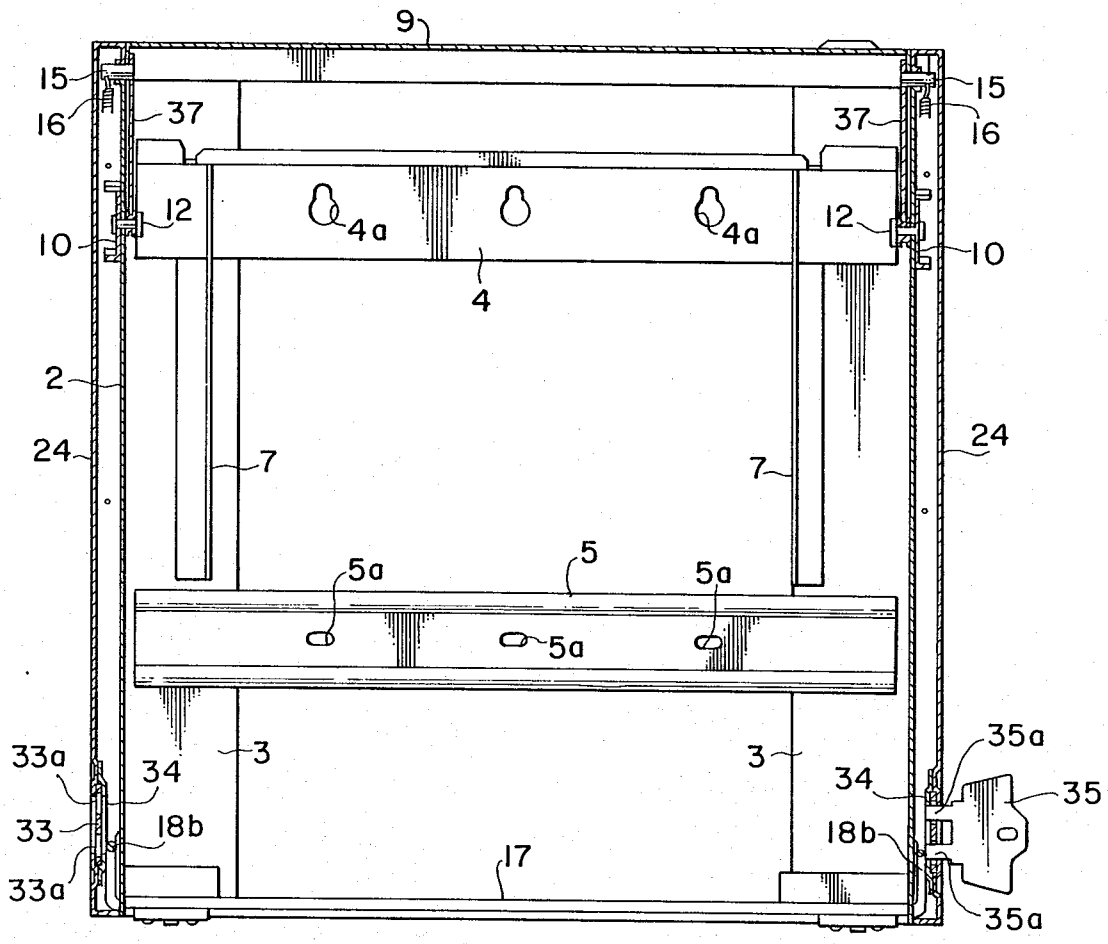
FIG. 1 is a section taken along the line C—C in FIG. 5.
Figure 2:
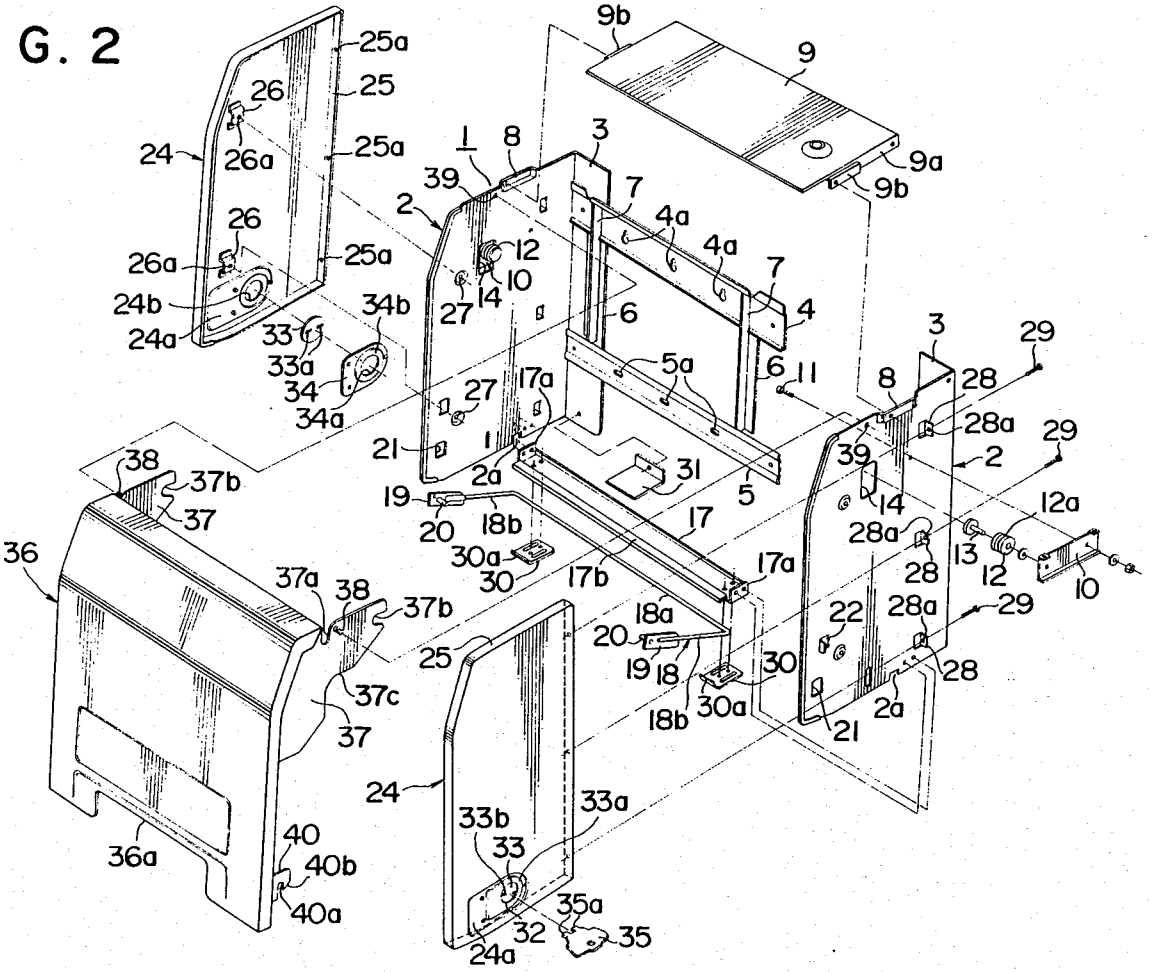
FIG. 2 is an exploded perspective view of a towel dispenser of the present invention.

Referring first to FIG. 2 which is an exploded view of a towel dispenser from which a towel unit has been taken out, a towel dispenser body generally designated by reference numeral 1 has a pair of side plates 2 which are disposed in a symmetrical manner. The rear edge of each side plate 2 is provided with a bent portion 3 which is bent inwardly in such a manner that it forms a right angle with respect to the side plate. A pair of horizontally extending supporting beams 4, 5 connect the upper and lower portions of the bent portions 3 on the inner sides thereof. The upper supporting beam 4 is provided with a plurality of through-holes 4*a* which are formed in the shape of keyholes, while the lower supporting beam 5 is provided with a plurality of slits 5*a* which are elongated in the horizontal direction and are formed at positions corresponding to those of the through-holes 4*a*.

The through-holes 4*a* or the slits 5*a* receive hooks or the like (not shown) projecting from the wall surface, to fix the body 1 onto the wall surface.

A connection rod 6 extends between each of the two ends of the upper beam 4 and corresponding ends of the lower beam 5. Each connection rod 6 is provided with a guide plate 7 which projects inward and extends in the vertical direction. The guide plates guide a towel accommodated in the interior of the body 1 in a manner described later.

The guide plates 7 are spaced apart from each other at the same spacing as the width of the towel and are located at a position where the towel passes.

The upper end portion of each side plate 2 is provided with an elongated protrusion 8 which protrudes outward, and by means of which a ceiling plate 9 is fixed to the side plates 2.

The ceiling plate 9 is rectangular in shape, and has downwardly bent portions 9*a* at two longitudinal edges thereof. The bent portions 9*a* extend from the rear edge of the ceiling plate 9 to the vicinity of the forward edge thereof, and each is provided with a lug 9*b* which fits onto the inner surface of the associated protrusion 8.

The lugs 9*b* which fit onto the inner sides of the protrusions 8 are fixed thereto by means of screws or the like, thus making the ceiling plate 9 form the upper side of the body 1.

A pivot arm 10 is pivotally supported at one end thereof by a screw 11 on the outer side and in the vicinity of the upper end portion of each of the side plates 2.

A roller 12 is pivotally supported on the inner side of the forward end portion of each of the pivot arms 10 by means of a pin 13. The roller 12 has an annular groove 12*a* thereon. It is received in an opening 14 formed in the vicinity of the upper end portion of the side plate 2 in such a way that it faces the inside of the side plate 2.

A spring 16 extends between the free end of each of the pivot arms 10 and a pin 15 projecting from the upper end portion of the side plate 2. The spring 16 urges the pivot arm 10 to pivot clockwise, as viewed in FIG. 2.

The opening 14 is elongated in the vertical direction, so that the roller 12 can move in the vertical direction along the whole length of the opening 14.

A supporting beam 17 connects the lower edges of the side plates 2 at the centers thereof.

The two ends of the supporting beam 17, which is pressed from a metal plate, have bent portions 17*a* which bend upward in such a manner that they form right angles with respect to the supporting beam. The bent portions 17*a* fit onto the outer sides of the lower end portions of the side plates 2, and are fixed thereto by means of screws or the like.

The supporting beam 17 is also provided with a guide rod 17*b* which extends along the entire length of the forward edge thereof. The guide rod 17*b* has a U-shaped cross-section with its open side facing downward. The guide rod 17*b* receives a linear portion 18*a* of a pivot rod 18 from below. The pivot rod 18 is a round metal bar, and is bent forward at two positions at right angles to form arms 18*b* at two end portions thereof.

The two ends of the linear portion 18*a* are received in notches 2*a* formed on the lower edges of the side plates 2 in such a manner that the arms 18*b* are located outside of the side plates 2.

A bracket 19 is fixed to the inner side of the leading end of each of the arms 18*b*, and a pin 20 is provided on the inner side of the leading end of each bracket 19.

Each pin 20 is received by an opening 21 formed in the vicinity of the lower end of the corresponding side plate 2, and on the side thereof which is closer to the forward end, in such a way that the leading end of the pin 20 is located inside of the side plate 2.

A lug 22 is punched out of each of the side plates 2 above the opening 21, and a spring 23 extends between the lug 22 and the leading end of the bracket 19, so as to urge the bracket 19 clockwise, as viewed in the figure, with respect to the pivot rod 18.

The towel dispenser body 1 further includes outer frames 24 disposed on the outer sides of the side plates 2. Each of the outer frames 24 is formed into substantially the same shape as the side plate 2, with the exception of the width thereof which is slightly smaller than that of the side plate 2.

The outer edge of each outer frame 24 is provided with a side wall 25 which is formed in such a manner that it projects toward the inside of the device. The side wall 25 extends along the entire periphery of the outer frame 24. It has a predetermined width, so that the side plate 24 forms a flat casing as a whole.

Brackets 26 are provided on the inner surface of each outer frame 24 at positions which are closer to the forward end thereof, and are separated from each other in the vertical direction. The brackets 26 each have a screw-hole 26*a* into which a screw (not shown) is threadedly fitted from an associated through-hole 27 formed in the side plate 2, so as to fix the forward side of the outer frame 24 onto the side plate 2.

Each side plate 2 is punched outward at positions which are closer to the rear end thereof and which are separated from each other in the vertical direction to form lugs 28. The lugs 28 projects from the side plate at right angles.

The lugs 28 each have a through-hole 28*a*. They are in contact with the outer side of the rear portion of the side wall 25 of the outer frame 24, and are fixed thereto by threadedly fitting screws 29 into the through-holes 28*a* and screw-holes 25*a* formed in the side wall 25.

In consequence, when each outer frame 24 is fixed onto the outer side of the corresponding side plate 2, it covers the pivot arm 10 and the arm 18*b* of the pivot rod 18 while maintaining them pivotally, making them invisible.

A supporting plate 30 is fixed by screws to the underside of each end of the supporting beam 17. The forward edge of the supporting plate 30 is provided with an upwardly curved portion 30*a* which pivotally supports each end of the linear portion 18*a* of the pivot rod 18 within each end of the guide rod 17*b*.

One end of a supporting plate 31 is secured to the lower edge of the bent portion 3 of each side plate 2 by a screw, while the other end of the supporting plate 31 is disposed on the upper side of the corresponding end of the supporting beam 17.

An inwardly recessed portion 24*a* is formed on each outer frame 24 at the lower edge and on the side which is closer to the forward edge thereof. The recessed portion 24*a* has a circular opening 24*b* at one end thereof, through which a locking device 32 comprising a disk 33 and a supporting plate 34 is mounted.

The disk 33 has a diameter which is slightly larger than that of the circular opening 24*b*, and is provided with two elongated openings 33*a* which receive two prongs 35*a* of a key 35.

The supporting plate 34 is provided with an opening 34*a* which has substantially the same diameter as that of the opening 24*b*, as well as an annular recessed portion 34*b* which surrounds the opening 34*a* and rotatably receives the disk 33. The supporting plate 34 is secured to the inner side of the recessed portion 24*a* in such a way that the opening 24*b*, the disk 33 and the opening 34*a* are coaxially aligned.

While the openings 33*a* are being aligned in the horizontal direction, the arms 18*b* of the pivot rod 18 are positioned below the openings 33*a*.

Figure 3:
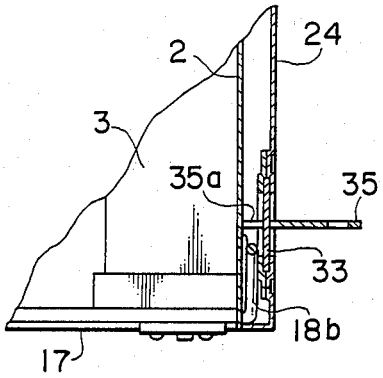
FIGS. 3 and 4 are cross-sectional views of an essential part of the towel dispenser, showing the pivot method.

In consequence, when the prongs 35*a* of the key 35 are inserted into one pair of the openings 33*a* in this state, the prongs 35 are located above the corresponding arm 18*b*, as shown in FIG. 3. When the key 35 is turned so that it becomes upright in this state, the prongs 35*a* press the arm 18*b* downward, pivoting the pivot rod 18.

A cover generally designated by reference numeral 36 is pressed into a shape which ensures that it covers substantially the entire front side of the body 1. The upper end portion of the cover 36 is provided with tabs 37 which come into contact with the inner sides of the side plates 2.

The outer side of the upper edge portion of each tab 37 is provided with a pin 38 which is pivotally received in a through-hole 39 formed in the vicinity of the upper edge portion of the corresponding side plate 2.

The upper edge portion of each tab 37 is also provided with a notch 37*a* at a position which is closer to the forward end thereof. The notches 37*a* together receive the forward edge of the ceiling plate 9.

The leading end portion of each tab 37 is provided with a notch 37*b* which is received in the annular groove 12*a* formed on each roller 12.

Each tab 37 also has a gently curved notch 37*c* formed at the center of the lower edge thereof and at a position which substantially corresponds to that of the notch 37*a*. The notches 37*c* fit into the annular grooves 12*a* of the rollers 12 when the cover 36 is closed.

A tab 40 projects toward the body from the inner side of each edge of the lower end portion of the cover 36 in such a manner that they form right angles with respect to the cover. The lower edge of each tab 40 has a notch 40*a* and a slope 40*b* extending from the lower edge of the leading end of the tab 40 to the notch 40*a*.

The lower edge of the cover 36 is provided with a rectangular notch 36*a* at the center thereof.

Figure 9:
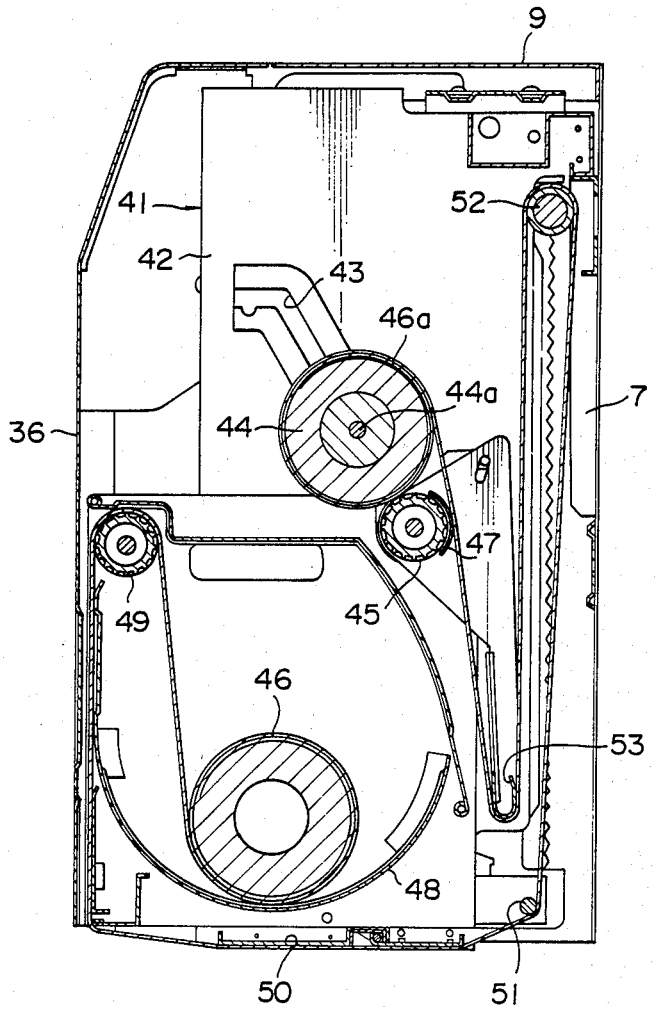
FIG. 9 is a cross-sectional view of the towel dispenser in which a towel unit is incorporated.

The body 1 releasably incorporates a towel unit such as that shown in FIG. 9.

The towel unit 41 has a pair of side plates 42 (one of which is not shown) disposed as two sides of the towel unit. The side plates 42 each have an L-shaped guide groove 43 at opposing positions thereon. A shaft 44*a* of a winding core 44 extends rotatably and slidably between the guide grooves 43.

The side plates 42 rotatably support a winding roller 45 therebetween in the vicinity of the lower end portions of the guide grooves 43. The winding roller 45 is rotated by a motor (not shown).

The winding roller 45 has an irregular surface with which a used towel 46*a* wound on the winding shaft 44 makes contact.

In consequence, when the winding roller 45 rotates, the winding core 44 is rotated through the layers of the used towel 46*a* thereon by friction, winding the used towel further thereon. As the diameter of the wound used towel increases, the support shaft 44*a* moves upward within the guide grooves 43.

An arcuate cover 47 is disposed between the winding roller 45 and the towel passage to prevent the towel coming into contact with the winding roller 45.

A towel receptacle 48 is provided between the lower portions of the side plates 42 to receive an unused towel 46.

The unused towel 46 is drawn out of the towel receptacle 48 toward the front side thereof by a supply roller 49 disposed above and in front of the receptacle 48. After passing below a bottom plate 50 of the towel unit 41, it is led upward by its contact with a guide shaft 51 disposed at the lower rear portion of the towel unit. The towel is then turned downward by a taxi roller 52, to be described later, and is again turned upward by its contact with the outer side of a guide plate 53 before being wound onto the winding core 44.

The taxi roller 52 can rise and lower freely. It raises the towel, as shown in FIG. 9, when it rises to its elevated position. When the taxi roller 52 lowers, however, the towel forms a loop hanging below the body 1, ready for use.

The winding roller 45 and supply roller 49 are rotated in synchronization with the rise and fall of the taxi roller 52 which is raised and lowered by pressing a switch (not shown). Further description of the construction of the taxi roller 52 is omitted.

The towel, when raised and lowered by the taxi roller 52, is led between the previously described guide plates 7.

The operation of the thus-arranged towel dispenser will be described below.

While the towel dispenser is ready for use with the towel unit 41 mounted within the body 1 and its cover 36 closed, the pins 20 provided at the leading ends of the arms 18*b* of the pivot rod 18 are fitted into the notches 40*a* of the tabs 40. The pins are kept engaged into the notches by the tensions of the springs 23, and the cover 36 is thereby kept locked and closed.

When it is necessary to replace the towel, the prongs 35*a* of the key 35 are inserted into the openings 33*a* of each disk 33 from outside the outer frame 24.

Figure 4:
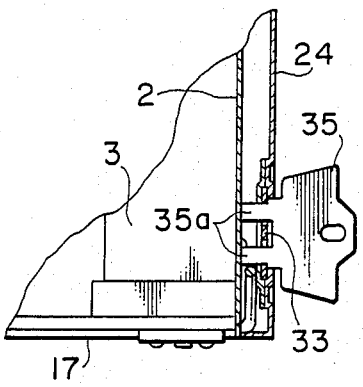
Figure 5:
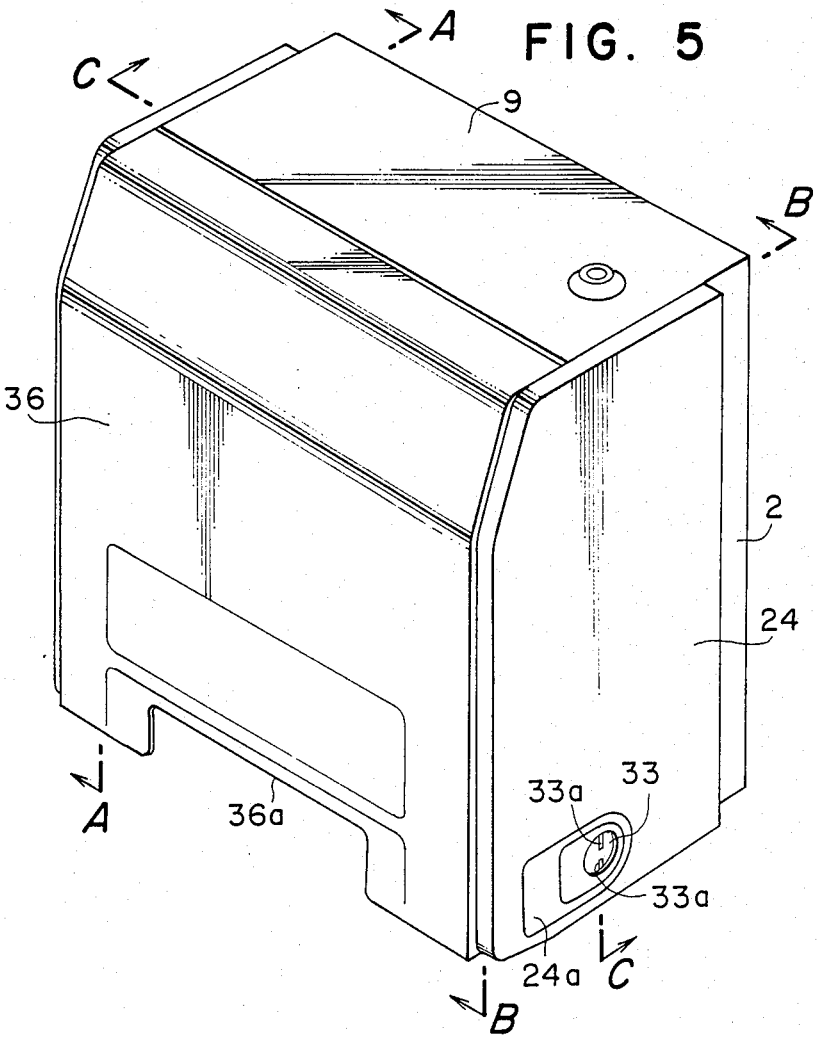
FIG. 5 is a perspective view of the entire towel dispenser.
Figure 6:
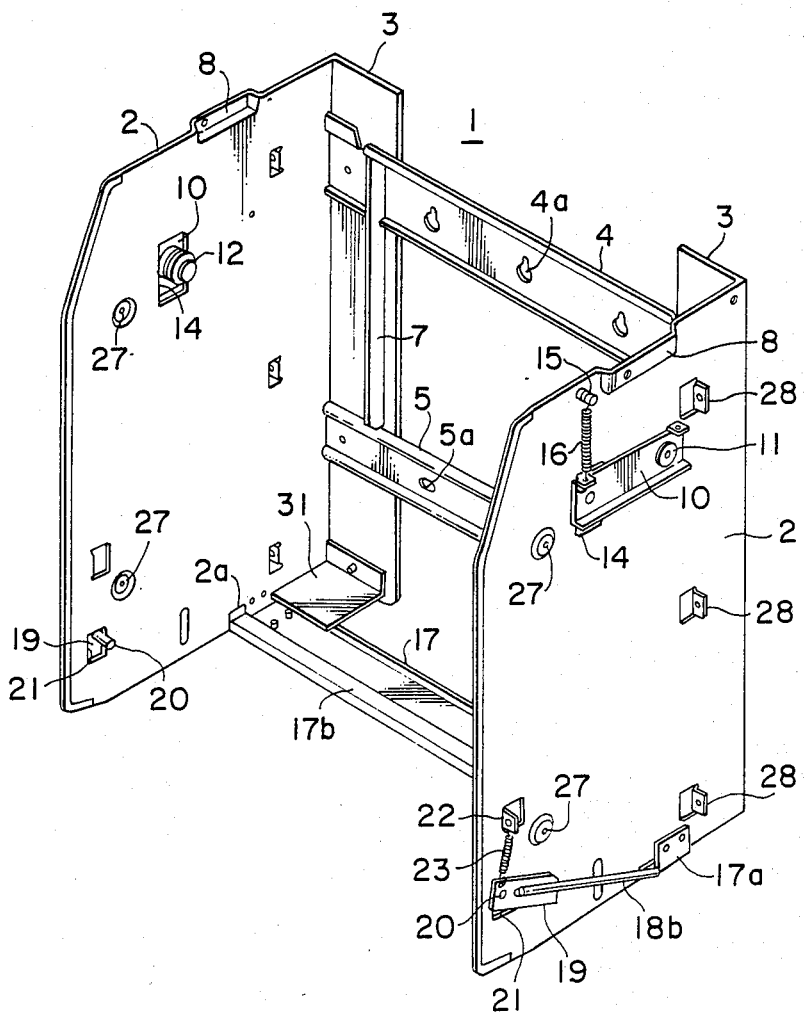
FIG. 6 is a perspective view of a body.

The key 35 is then turned in either direction with the prongs 35*a* thereof in contact with the arm 18*b* of the pivot rod 18. This pushes the arm 18*b* down, as shown in FIG. 4, and pivots the pivot rod 18.

This releases the pins 20 from the notches 40*a* of the tabs 40, unlocking the cover 36 and leaving it ready to be opened.

While the cover 36 is being opened upward, the notches 37*c* of the tabs 37 push the rollers 12 downward, pivoting the pivot arms 10 downward. The rollers 12 thereby leave the notches 37*c* and are received in the notches 37*b* after being guided along the slopes formed at the lower edges of the tabs 37.

Figure 7:
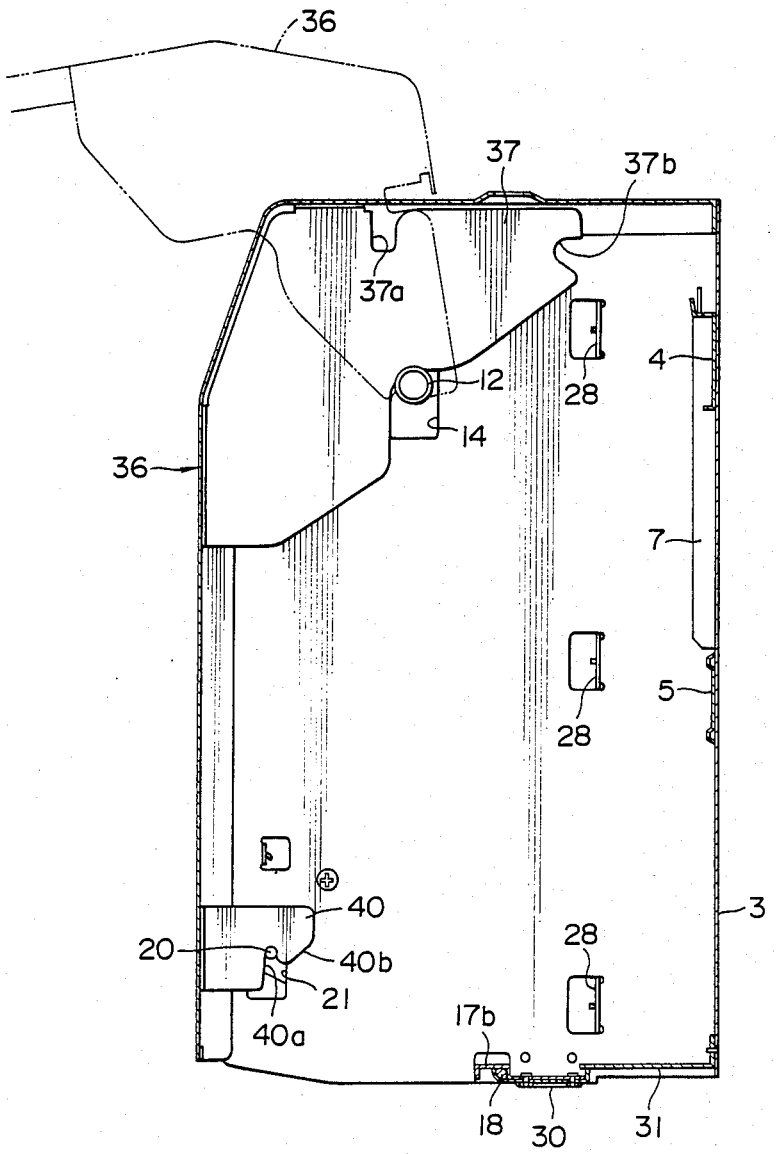
FIG. 7 is a section taken along the line A—A of FIG. 5.
Figure 8:
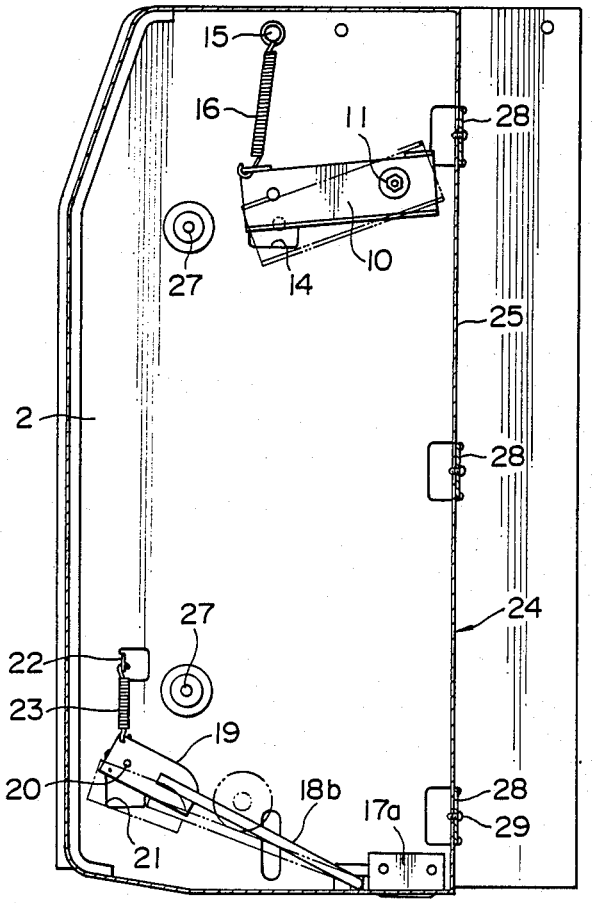
FIG. 8 is a section taken along the line B—B of FIG. 5.

At this time, the forward edge of the ceiling plate 9 is received in the notches 37*a*, so that the cover 36 can be fully opened, as shown in FIG. 7.

The engagement of the rollers 12 in the notches 37*b* is maintained by the tensions of the springs 16, and the cover 37 is thereby kept open.

The towel unit is replaced in this state.

When the cover 36 is pivoted toward its closed position after the towel unit has been replaced, a large angular moment is applied to the rollers 12, pushing the pivot arms 10 and the rollers 12 downward against the forces of the springs 16 and releasing the rollers 12 from the notches 37*b*.

When the cover 36 is further pivoted and starts to close, the tabs 40 approach the pins 20 provided at the leading ends of the arms 18*b* of the pivot rod, and the slopes 40*b* run onto the upper sides of the pins 20, pushing the arms 18*b* downward against the forces of the springs 23.

This causes the pins 20 to be fitted into the notches 40*a*. This engagement of the pins into the notches 40*a* is maintained by the tensions of the springs 23, and the cover is thereby kept locked.

The towel is raised and lowered by the taxi roller 52, as described above, to form and break a loop. Since it is led between the guide plates 7 while it is being raised and lowered, it is prevented from displacing sideways, and is wound in good order without snaking or becoming inclined.

The towel dispenser of this embodiment employs the towel unit which is detachably mounted in its body and in which the towel is raised and lowered by the taxi roller. However, it has the same advantages when applied to any type of towel dispenser, including one in which only the towel is detachably mounted in the body and one which does not employ a taxi roller, so long as the towel passageway is provided with the above-described guide plates.

What is claimed is:

1. A towel dispenser incorporating:

a cover secured to upper end portions of two side plates of a towel dispenser body as a front lid in such a manner as to be openable;

a pin for pivotally supporting said cover, said pin being provided on a tab projecting toward the body from each edge of an upper end portion of said cover;

a pivot arm having one end which is pivotally supported on an outer side of each of said side plates of the body and another, free end which can be pivoted upward; and a roller provided at the free end of said pivot arm and located at a position where said roller can be engaged with each of said tabs of said cover through an opening formed on each of said side plates.

2. A towel dispenser according to claim 1, wherein a leading end of each of said tabs projecting from said cover is provided with a notch which is engaged with said roller in one position of said cover, and a slope forming a lower edge of each said tab is provided midway therealong with a respective gently curved notch which is engaged with said roller in another position of said cover.

3. A towel dispenser incorporating:

a cover secured to upper end portions of two side plates of a towel dispenser body as a front lid in such a manner as to be openable;

a pivot rod pivotally supported between said two side plates of a towel dispenser body at a position where said pivot rod does not interrupt feeding of a towel, said pivot rod having arms at two ends thereof which extend forward in such a manner that said arms form right angles with a central portion of said pivot rod;

a pin provided on an inner side of a leading end of each of said arms of said pivot rod, said pin being received in a notch of a tab provided on an inner side of each edge of a lower end portion of said openable cover; and a disk rotatably mounted on an outer frame fixed to an outer side of each of said side plates of the body in such a manner as to cover said side plate, said disk having openings into which prongs of a key can be engaged.

4. A towel dispenser according to claim 3, wherein said openings of said disk into which the prongs of a key can be engaged are disposed in such a manner that said openings are positioned above each of said two arms of said pivot rod while said two arms are aligned in a horizontal direction.

5. A towel dispenser incorporating:

a pair of guide plates provided along a towel passageway of a towel dispenser body at the same spacing as the width of a towel;

a cover secured to the upper end portions of two side plates of said towel dispenser body as a front lid in such a manner as to be openable;

a pin for pivotally supporting said cover, said pin being provided on a tab projecting toward the body from each edge of the upper end portion of said cover;

a pivot arm having one end which is pivotally supported on the outer side of each of said side plates of said body and another, free end which can be pivoted upward; and a roller provided at the free end of said pivot arm and located at a position where it can be engaged with each of said tabs of said cover through an opening formed on each of said side plates.

6. A towel dispenser incorporating:

a pair of guide plates provided along a towel passageway of a towel dispenser body at the same spacing as the width of a towel;

a pivot rod pivotally supported between two side plates of said towel dispenser body at a position where said pivot rod does not interrupt feeding of a towel, said pivot rod having arms at two ends thereof which extend forward in such a manner that they form right angles with a central portion of said pivot rod;

a pin provided on an inner side of a leading end of each of said arms of said pivot rod, said pin being received in a notch of a tab provided on an inner side of each edge of a lower end portion of an openable cover; and a disk rotatably mounted on an outer frame fixed to an outer side of each of said side plates of said body in such a manner as to cover said side plates, said disk having openings into which prongs of a key can be engaged.

7. A towel dispenser incorporating:

a cover secured to upper end portions of two side plates of said towel dispenser body as a front lid in such a manner as to be openable;

a pin for pivotally supporting said cover, said pin being provided on a tab projecting toward said body from each edge of an upper end portion of said cover;

a pivot arm having one end which is pivotally supported on an outer side of each of said side plates of the body and another, free end which can be pivoted upward;

a roller provided at the free end of said pivot arm and located at a position where said roller can be engaged with each of said tabs of said cover through an opening formed on each of said side plates;

a pivot rod pivotally supported between said two side plates of said towel dispenser body at a position where said pivot rod does not interrupt feeding of a towel, said pivot rod having arms at two ends thereof which extend forward in such a manner that they form right angles with a central portion of said pivot rod;

a pin provided on an inner side of a leading end of each of said arms of said pivot rod, said pin being received in a notch of a tab provided on an inner side of each edge of a lower end portion of the openable cover; and a disk rotatably mounted on an outer frame fixed to an outer side of each of said side plates of said body in such a manner as to cover said side plates, said disk having openings into which prongs of a key can be engaged.

8. A towel dispenser incorporating:

a pair of guide plates provided along a towel passageway of a towel dispenser body at the same spacing as the width of a towel;

a cover secured to upper end portions of two side plates of said towel dispenser body as a front lid in such a manner as to be openable;

a pin for pivotally supporting said cover, said pin being provided on a tab projecting toward the body from each edge of an upper end portion of said cover;

a pivot arm having one end which is pivotally supported on an outer side of each of said side plates of said body and another, free end which can be pivoted upward;

a roller provided at the free end of said pivot arm and located at a position where said roller can be engaged with each of said tabs of said cover through an opening formed on each of said side plates;

a pivot rod pivotally supported between said two side plates of said towel dispenser body at a position where said pivot rod does not interrupt feeding of a towel, said pivot rod having arms at two ends thereof which extend forward in such a manner that they form right angles with a central portion of said pivot rod;

a pin provided on an inner side of a leading end of each of said arms of said pivot rod, said pin being received in a notch of a tab provided on an inner side of each edge of a lower end portion of said openable cover; and a disk rotatably mounted on an outer frame fixed to an outer side of each of said side plates of said body in such a manner as to cover said side plates, said disk having openings into which prongs of a key can be engaged.

* * * * *

UNITED STATES PATENT AND TRADEMARK OFFICE

CERTIFICATE OF CORRECTION

PATENT NO. : 4,856,854

DATED : August 15, 1989

INVENTOR(S) : Masanobu Nishiyama et al

It is certified that error appears in the above-identified patent and that said Letters Patent is hereby corrected as shown below:

On the title page Insert

--(30) Foreign Application Priority Data

| | | |
|---|---|---|
| June 20, 1986 (JP) | Japan | 61-144266 |
| June 20, 1986 (JP) | Japan | 61-144267 |
| June 20, 1986 (JP) | Japan | 61-144268--. |

Signed and Sealed this

Eighth Day of May, 1990

*Attest:*

HARRY F. MANBECK, JR.

*Attesting Officer*

*Commissioner of Patents and Trademarks*